US011230678B2

(12) United States Patent
Lan et al.

(10) Patent No.: US 11,230,678 B2
(45) Date of Patent: Jan. 25, 2022

(54) INTEGRATED METHOD AND INTEGRATED DEVICE FOR HEAVY OIL CONTACT LIGHTENING AND COKE GASIFICATION

(71) Applicant: CHINA UNIVERSITY OF PETROLEUM-BEIJING, Beijing (CN)

(72) Inventors: Xingying Lan, Beijing (CN); Yuming Zhang, Beijing (CN); Jinsen Gao, Beijing (CN); Chengxiu Wang, Beijing (CN); Xiaogang Shi, Beijing (CN)

(73) Assignee: CHINA UNIVERSITY OF PETROLEUM-BEIJING, Beijing (CN)

( * ) Notice: Subject to any disclaimer, the term of this patent is extended or adjusted under 35 U.S.C. 154(b) by 0 days.

(21) Appl. No.: 17/028,980

(22) Filed: Sep. 22, 2020

(65) Prior Publication Data

US 2021/0087484 A1 Mar. 25, 2021

(30) Foreign Application Priority Data

Sep. 23, 2019 (CN) ..... 201910900580.2

(51) Int. Cl.
*C10J 3/56* (2006.01)
*C10J 3/54* (2006.01)
(Continued)

(52) U.S. Cl.
CPC ..... *C10J 3/56* (2013.01); *C10B 55/00* (2013.01); *C10G 1/002* (2013.01); *C10G 1/045* (2013.01);
(Continued)

(58) Field of Classification Search
CPC ..... C10G 55/06; C10G 2300/107; C10G 2400/06; C10G 2300/70; C10G 2300/4025; C10G 2300/30; C10G 2300/4081; C10G 2300/1077; C10J 3/56; C10J 2300/0943; C10J 2300/1615; C10J 2300/1807; C10J 3/721; C10J 2300/0959; C10J 2300/0956;
(Continued)

(56) References Cited

U.S. PATENT DOCUMENTS 4,325,815 A * 4/1982 Metrailer ..... C10B 55/10 208/127
4,511,459 A * 4/1985 Yan ..... C10G 9/32 201/17

FOREIGN PATENT DOCUMENTS

CN 101451073 A 6/2009

* cited by examiner

*Primary Examiner* — Randy Boyer
*Assistant Examiner* — Juan C Valencia
(74) *Attorney, Agent, or Firm* — J.C. Patents

(57) ABSTRACT

An integrated method and an integrated device for heavy oil contact lightening and coke gasification are provided. The integrated method uses a coupled reactor including a cracking section and a gasification section, and the integrated method includes: feeding a heavy oil material into the cracking section to implement a cracking reaction, to obtain a light oil gas and a carbon-deposited contact agent; passing the carbon-deposited contact agent into the gasification section, so as to implement a gasification reaction, to obtain a regenerated contact agent and a syngas; and discharging the light oil gas and the ascended and incorporated syngas from the cracking section, to perform a gas-solid separation, so that the carbon-deposited contact agent carried is separated and returned to the cracking section, and a purified oil gas is obtained at the same time.

8 Claims, 3 Drawing Sheets

(51) Int. Cl.
*C10G 1/00* (2006.01)
*C10B 55/00* (2006.01)
*C10G 1/04* (2006.01)

(52) U.S. Cl.
CPC ..... *C10J 3/54* (2013.01); *C10J 2300/0903* (2013.01); *C10J 2300/1807* (2013.01); *C10J 2300/1884* (2013.01)

(58) Field of Classification Search
CPC ..... C10J 2300/0976; C10J 3/482; C10J 2300/0989; C10J 3/62; C10J 2300/0986; C10J 3/12; C10K 1/026; C10K 1/024
See application file for complete search history.

INTEGRATED METHOD AND INTEGRATED DEVICE FOR HEAVY OIL CONTACT LIGHTENING AND COKE GASIFICATION

CROSS-REFERENCE TO RELATED APPLICATION

This application claims priority to Chinese Patent Application No. 201910900580.2, filed on Sep. 23, 2019, which is hereby incorporated by reference in its entirety.

TECHNICAL FIELD

The present disclosure relates to a heavy oil upgrading technology, and in particular, to an integrated method and an integrated device for heavy oil contact lightening and coke gasification.

BACKGROUND

The heavy oil is a residue left after the crude oil is subjected to fractionation to extract gasoline, kerosene, and diesel; furthermore, there are also abundant heavy oil resources in strata. The heavy oil has the characteristics of, for example, heavy components and low hydrogen-carbon ratio, and usually has a relatively high content of sulfur, nitrogen, heavy metals and carbon residue value, etc. With the continuous development of crude oil, the problems of heavy and inferior quality of crude oil have become more and more serious, and environmental protection regulations are becoming stricter, so how to lighten the heavy oil, and convert the heavy oil into gasoline, diesel, liquefied gas and other qualified clean oil products are main challenges faced by petroleum processing enterprises at present.

At present, the processing route for lightening the heavy oil can be roughly divided into two types, hydrogenation and decarbonization. Among them, the hydrogenation is to increase the hydrogen-carbon ratio by the reaction of the heavy oil with hydrogen. The hydrogenation occupies an important position in the processing of the heavy oil, but due to high content of carbon residue value, heavy metal and heteroatom in the heavy oil, direct use of hydrocracking method often requires a large amount of hydrogen, and usually needs to be carried out under the conditions of high pressure and high efficient catalyst, the difficulty of implementing the process is relatively high. Additionally, since the heavy oil has a relatively low hydrogen-carbon ratio, the problem of lack of hydrogen in the process of obtaining clean oil products by lightening of the heavy oil is often more prominent.

Since the addition of external hydrogen resources is not involved, the decarbonization processing is generally a redistribution of carbon and hydrogen resources of raw materials in products. Currently, the commonly used decarbonization technologies at home and abroad mainly include a catalytic cracking process and a delayed coking process. Among them, the catalytic cracking process usually causes rapid carbon deposition on or toxic deactivation of the catalyst, and the amount of coke formation in the heavy oil catalytic cracking process is relatively large, and if a traditional coking method is used for catalyst regeneration, a large amount of external heat will be required, and at the same time, it will also be a great waste of carbon resources to a certain extent. During the delayed coking process, since no catalyst is involved, the delayed coking process has greater adaptability to raw materials. However, the delayed coking process produces a large amount of solid coke as a by-product, and the latest environmental protection requirements have taken measures to restrict the high-sulfur coke with a sulfur content of >3% from leaving from factory, thus the application of the delayed coking process is limited.

In view of the above advantages and disadvantages of the hydrogenation and the decarbonization, firstly cracking the heavy oil into light oils and then hydrotreating the light oils to obtain acceptable products has become a choice of many petroleum processing enterprises.

CN1504404A discloses a process method for combining oil refining and gasification. First, a petroleum hydrocarbon and a coke transfer agent contact and react with each other in a reactor, and the resulting oil gas enters a subsequent product separation system, the coke transfer agent deposited with carbon is transferred into a gasifier, and reacts with, for example, water vapor and oxygen-containing gas so as to produce a syngas, and achieve the regeneration of the coke transfer agent deposited with carbon. The regenerated coke transfer agent is returned into a cracking section for recycling. The present disclosure achieves a combination of two processes of oil refining and gasification, the process flow is similar to the catalytic cracking process, and the coke gasification process is used to replace the traditional coking regeneration process.

CN102234534A discloses a method for processing an inferior heavy oil, where the method firstly uses a contact agent with low activity to perform a cracking reaction of the heavy oil, the reacted contact agent deposited with carbon is transported to different reaction zones of the gasification section to perform combustion or gasification regeneration, to obtain a semi-regenerant and a secondary regenerant with different coke content, respectively; the multi-section regenerating reaction in the reactor increases the operation difficulty of the process to a certain extent.

CN102115675A discloses a processing method of heavy oil lightening and a device thereof. Firstly, the raw oil reacts with a solid heat carrier in a thermal cracking reactor to obtain a light oil gas product. The heavy coke is attached to a surface of the solid heat carrier and enters a combustion (gasification) reactor through a material returning valve to remove the coke on the surface, and the regenerated high-temperature solid heat carrier is partially returned to the thermal cracking reactor through a distribution valve, serving as a reaction bed material.

CN102965138A discloses a coupling process of pyrolysis and gasification for a heavy oil in a double-reaction-tube semi-coke circulating bed, which proposes the use of a descending reaction tube for cracking of the heavy oil to obtain a light oil gas product. The coked semi-coke enters the riser gasification reactor to perform a gasification reaction with an oxidant and water vapor, to produce a syngas; after the reaction, the high-temperature semi-coke flows into the material returning device and continues to circulate, so as to provide the heat required for the heavy oil reaction.

In the above methods, different types of reactors, such as a fluidized bed, a riser and a downer, are used for the cracking reaction of the heavy oil. However, generated heavy cokes need to be transported to another reactor for performing regeneration reaction such as gasification and combustion, so that materials have to be recycled and returned in multiple reactors, not only making the equipment occupy a larger area in practical production, but also having high energy consumption.

SUMMARY

In view of the above defects, the present disclosure provides an integrated method for heavy oil contact lightening and coke gasification, which can achieve mutual supply of materials and mutual complementation of heat in two reaction processes of the heavy oil cracking and the coke gasification, thereby reducing energy consumption in heavy oil processing and saving equipment occupied area.

The present disclosure further provides an integrated device for heavy oil contact lightening and coke gasification, the utilization of the integrated device for processing a heavy oil, can implement the aforementioned integrated method, thereby reducing energy consumption and saving equipment occupied area.

In order to achieve the above object, the present disclosure provides an integrated method for heavy oil contact lightening and coke gasification, the integrated method uses a coupled reactor as a reactor, the coupled reactor includes a cracking section at an upper part and a gasification section at a lower part, and the cracking section and the gasification section communicate with each other; the integrated method includes:

feeding a heavy oil material into the cracking section of the coupled reactor, so as to contact with a contact agent to implement a cracking reaction, to obtain a light oil gas and a carbon-deposited contact agent;

passing the carbon-deposited contact agent into the gasification section, so as to implement a gasification reaction with a gasification agent and regenerate the contact agent, to obtain a regenerated contact agent and a syngas; where the regenerated contact agent after being cooled by heat exchange is returned into the cracking section for recycling; and the syngas ascends into the cracking section;

discharging the light oil gas and the ascended and incorporated syngas from the cracking section, to perform a gas-solid separation, so that the carbon-deposited contact agent carried is separated and returned to the cracking section, and a purified oil gas is obtained at the same time.

In the integrated method for heavy oil contact lightening and coke gasification provided by the present disclosure, the heavy oil material enters into the cracking section at the upper part of the coupled reactor, and is cracked by contacting with the contact agent, and a decarbonization and upgrading reaction occurs, to obtain the light oil gas and the coke. The cokes adhere to a surface of the contact agent, to become the carbon-deposited contact agent. The carbon-deposited contact agent enters into the gasification section, so that the coke on the surface of the contact agent undergoes a gasification reaction with the gasification agent entered into the gasification section, to achieve the regeneration of the contact agent while obtaining a high-temperature syngas.

The high-temperature syngas ascends into the cracking section, which can not only provide heat required for the cracking reaction, but also the highly active hydrogen-rich syngas can further provide a hydrogen atmosphere for cracking of the heavy oil, so as to inhibit coking in the process of the heavy oil cracking and increase yield of the light oil gas to a certain extent. Furthermore, the syngas enters from a bottom of the cracking section and ascends to incorporate into the light oil gas, which can also ensure full fluidization of the contact agent i, and further increase the yield of the light oil gas.

The regenerated high-temperature contact agent can first exchange heat with a heat-taking medium, for example, water, low temperature water vapor, etc., so that the regenerated contact agent is reduced to a suitable temperature, and then returned to the cracking section for recycling. Additionally, the regenerated contact agent can also provide part of the heat and catalytic activity required for cracking of the heavy oil in the cracking section.

The high-temperature light oil gas and the syngas ascend and discharge from the cracking section, and then are subjected to a gas-solid separation, so as to remove the carried carbon-deposited contact agent. The separated carbon-deposited contact agent can be returned into the cracking section and be recycled as a bed material for cracking of the heavy oil. At the same time, the obtained purified oil gas can be used to obtain a gas product such as a syngas, a dry gas and a liquefied gas, and a light oil product as well as possibly a heavy oil product by means of oil and gas fractionation, etc. Among them, the light oil product can be further cut to obtain liquid products with different distillation ranges, the heavy oil product can be returned to the cracking section for recycling and refining and processing; and the syngas can be used as a source of hydrogen in refineries.

Thus it can be seen that the present disclosure integrates the cracking section and the gasification section in the same coupled reactor, achieving mutual supply of materials and mutual complementation of heat in two reaction processes, i.e., the heavy oil cracking and the coke gasification. Compared with current process of heavy oil catalytic cracking and coke gasification, in which materials are transported and circulated among multiple reactors, the integrated method provided by the present disclosure can not only significantly reduce energy consumption during heavy oil processing and increase the yield of the light oil gas, but also solve the problem of high difficulty in material circulation operation at present, as well as solves the problem of large occupied area and high investment of the existing heavy oil processing devices.

The present disclosure does not specifically limit the aforementioned heavy oil material, for example, the heavy oil material can be one of viscous oil, super viscous oil, oil sand asphalt, atmospheric pressure heavy oil, vacuum residue, catalytic cracking slurry and solvent deoiled asphalt, etc., or a mixture of more thereof; and the heavy oil material can also be one of heavy tar and residue oil produced in the process of coal pyrolysis or liquefaction, heavy oil produced in the process of oil shale retorting, and derived heavy oil such as liquid product of low-temperature pyrolysis in biomass, or a mixture of more thereof.

The Inventors have found through research that the integrated method provided by the present disclosure has a good treatment effect on a heavy oil material with Conradson' carbon residue value of above 10 wt %, and still has very good treatment effect even on the heavy oil material with Conradson' carbon residue value of above 15 wt %, capable of obtaining a large number of light oil gases.

The contact agent used in the present disclosure can be a commonly used contact agent for decarbonization and upgrading at present, for example, it can be a silicon-aluminum material such as quartz sand, kaolin, clay, alumina, silica sol, montmorillonite, and illite, and it can also be an industrial balance agent or spent catalyst in fluid catalytic cracking (FCC), or one or more of red mud, steel slag, blast furnace ash, coal ash and other solid particles.

The inventors have found through research that it is preferable to select a contact agent with relatively low cracking activity. For example, a contact agent with the micro-activity index of 5-30 is selected to ensure relatively high cracking efficiency and yield of light oil in the process of cracking of the heavy oil. In a specific implementation of the present disclosure, the micro-activity index of the contact agent used is 10-20, for example, kaolin, clay, alumina, silica sol, and industrial balance agent or spent catalyst in the process of catalytic cracking, etc.

Further, the contact agent is preferably in the shape of microsphere, its particle size distribution is preferably in the range of 10-500 μm, so as to have good fluidization performance; in a specific implementation of the present disclosure, the particle size distribution of the used contact agent is in the range of 20-200 μm.

In the present disclosure, in the process of cracking of the heavy oil, a relatively high content of coke is preferably formed on the surface of the carbon-deposited contact agent, that is, the carbon-deposited contact agent having a relatively high content of coke enters into the gasification section to implement the gasification reaction, which is capable of preventing heating and cooling of a large number of contact agents in the process of the cracking reaction and the gasification reaction and ensure that the energy consumed in the process of heating is mainly used for the gasification reaction of the coke, thereby improving overall energy efficiency of the entire process of heavy oil processing.

Specifically, in the process of cracking, it is preferable to maintain the mass content of the coke on the surface of the contact agent above 20%. For example, a small weight ratio of the contact agent to the heavy oil (i.e. agent-oil ratio) can be used to ensure that a high content of coke is formed on the surface of the contact agent during the cracking process of the heavy oil.

In a specific implementation of the present disclosure, within the cracking section, a reaction temperature is usually controlled to be 450-700° C., a reaction pressure is controlled to be 0.1-3.0 Mpa, a reaction time is controlled to be 1-20 s, a superficial gas velocity is controlled to be 1-20 m/s, a weight ratio of the contact agent to the heavy oil material (agent-oil ratio) is controlled to be 0.1-1.0:1. Preferably, the reaction temperature of the cracking reaction is 480-580° C., the reaction pressure is 0.1-1.0 Mpa, for example, normal pressure, the reaction time is 3-15 s, the superficial gas velocity is 1-20 m/s, and the agent-oil ratio is 0.2-1.0:1, preferably 0.2-0.5:1.

At present, the agent-oil ratio during catalytic cracking of the heavy oil is usually greater than 1, the content of the coke on the surface of the catalyst (contact agent) is usually less than 5%, and thus, in the process of gasification regeneration, a large amount of heat needs to be consumed to heat the catalyst and provide heat for the cracking reaction, resulting in relatively low efficiency and relatively high energy consumption in the process of heavy oil lightening. Compared with the prior art, due to a relatively low agent-oil ratio in the process of cracking reaction, which can even be controlled below 0.5, such as 0.2-0.5, the use of the integrated method provided by the present disclosure does not require a large number of heat to achieve the regeneration of the contact agent, and the syngas produced in the process of the regeneration of the contact agent also provides heat for the cracking reaction, thus the entire heavy oil lightening process has very low energy consumption, significantly reducing the production cost of heavy oil processing.

The present disclosure does not specifically limit the gasification agent entering into the gasification section, and for example, the gasification agent can be water vapor, and it can also be oxygen-containing gas or a mixed gas of water vapor and oxygen-containing gas. The oxygen-containing gas can be, for example, air, oxygen, etc.

In a specific implementation of the present disclosure, within the gasification section, a reaction temperature is generally controlled to be 850-1200° C., a reaction pressure is generally controlled to be 0.1-6.0 Mpa, and a superficial gas velocity is generally controlled to be 0.1-5 m/s, residence time of the carbon-deposited contact agent can be controlled to be 1-20 min. The gasification reaction under the above conditions can ensure that the coke on the surface of the contact agent react is fully reacted to achieve the regeneration of the contact agent, and a syngas with high quality is obtained.

The syngas ascends into the cracking section from the gasification section, which not only can ensure the fluidization of the contact agent, but also provide heat required for the cracking reaction; additionally, the highly active hydrogen-rich syngas can further provide a hydrogen atmosphere for the cracking of the heavy oil, so as to inhibit the coke formation in the heavy oil cracking process and increase yield of the light oil gas. In practical production, excess syngas can also enrich the source of hydrogen in refineries.

In the present disclosure, before the carbon-deposited contact agent enters into the gasification section to implement the gasification reaction for regeneration, it is preferable to first perform a water vapor stripping treatment, so as to thoroughly remove a small amount of light oil gas remaining in the carbon-deposited contact agent, thereby facilitating the smooth progress of the gasification reaction. Specifically, after the water vapor stripping treatment, the carbon-deposited contact agent in the cracking section is transported outside the coupled reactor into the gasification section for regeneration.

In a specific implementation of the present disclosure, when performing the above water vapor stripping treatment, a mass ratio of the water vapor to the heavy oil material is controlled to be 0.03-0.3:1, a temperature of the water vapor is 200-400° C., a superficial gas velocity of the water vapor is 0.5-5.0 m/s. The water vapor can be obtained from low temperature water vapor or by heat exchange between water and the regenerated contact agent.

In the present disclosure, the carbon-deposited contact agent and the regenerated contact agent can be transported in the following three ways:

1) The carbon-deposited contact agent in the cracking section descends, and after the water vapor stripping treatment, it descends outside the coupled reactor and enters into the gasification section; after the carbon-deposited contact agent in the gasification section completes the gasification of the coke to achieve the regeneration, the obtained regenerated contact agent is led out of the gasification section, and is returned into the cracking section after being cooled by heat exchange through an external heat exchanger.

2) The carbon-deposited contact agent in the cracking section is led out of the upper part of the cracking section after water vapor stripping, descends outside the coupled reactor into the middle part of the gasification section. After the carbon-deposited contact agent is subjected to gasification and regeneration in the gasification section, the obtained regenerated contact agent undergoes a heat exchange through an internal heat exchanger, and then ascends into the cracking section together with the syngas.

In this case, the entire coupled reactor is similar to an updraft fluidized bed, the gas velocity in the coupled reactor is large, and a heavy oil material inlet is located at the lower part of the cracking section.

3) The carbon-deposited contact agent in the cracking section descends from the cracking section, and after water vapor stripping, the carbon-deposited contact agent is led out of the cracking section, and enters into the middle of the gasification section from the outside of the coupled reactor, and after the carbon-deposited contact agent is subjected to gasification and regeneration in the gasification section, the obtained regenerated contact agent is returned into the cracking section after being cooled by heat exchange through an external heat exchanger.

Before the high-temperature light oil gas and the syngas are discharged from the top of the cracking section, the carbon-deposited contact agent carried therein is led out of the cracking section and enters into the gasification section for gasification and regeneration, the obtained regenerated contact agent is returned into the cracking section after heat exchange through an external heat exchanger.

In the present disclosure, the light oil gas and the syngas are led out of the cracking section, and then are subjected to a gas-solid separation, so that a few of the carbon-deposited contact agent carried therein is separated, and the purified oil gas is obtained. The present disclosure does not particularly limit the specific gas-solid separation method, gas-solid separation methods commonly used in the field of petroleum processing can be used, such as cyclone separation.

Preferably, before the light oil gas and the syngas are subjected to the gas-solid separation, a washing and cooling treatment can be first performed on them, for example, they are subjected to heat exchange washing with a low temperature liquid oil such as a heavy oil material, so as to remove a small amount of fine powder of the contact agent carried in the high-temperature oil gas, and at the same time, the cooling and washing treatment can be used as a desuperheating section of the high-temperature oil gas, so as to inhibit reactions such as excessive cracking and coke formation. And since the amount of the heavy oil material after heat absorption is small, and the heavy oil material is dispersed after exchanging heat with the high-temperature light oil gas and the syngas, the heavy oil material can be used directly as a raw material for the cracking reaction.

As discussed above, the regenerated contact agent obtained by the gasification and regeneration in the gasification section can exchange heat through the heat exchanger arranged outside the coupled reactor, so that the temperature is reduced to a suitable temperature, and then the regenerated contact agent enters into the cracking section; or, the regenerated contact agent can also enter into the cracking section after being cooled by heat exchange through the heat exchanger arranged inside the coupled reactor. Compared with the internal heat exchanger, the use of the external heat exchanger is more conducive to flexible control of parameters such as the temperature of the regenerated contact agent after heat exchange, the rate at which the regenerated contact agent returns to the cracking section, and can increase the flexibility and reliability of operation to a certain extent.

The present disclosure further provides an integrated device for heavy oil contact lightening and coke gasification, for implementing the above integrated method, where the integrated device at least includes a coupled reactor, a heat exchanger and a gas-solid separator, where:

the coupled reactor includes a cracking section at an upper part and a gasification section at a lower part, and the cracking section and the gasification section communicate with each other;

the cracking section has a heavy oil material inlet, a carbon-deposited contact agent return port, a carbon-deposited contact agent outlet and an oil gas outlet; the gasification section has a gasification agent inlet and a carbon-deposited contact agent inlet; the carbon-deposited contact agent outlet of the cracking section is connected with the carbon-deposited contact agent inlet of the gasification section through an external transportation pipeline;

the heat exchanger is arranged inside the coupled reactor, or the heat exchanger is arranged outside the coupled reactor and is connected with the cracking section and the gasification section;

the gas-solid separator has an inlet, a solid discharge outlet and a gas discharge outlet, where the inlet of the gas-solid separator is connected with the oil gas outlet of the cracking section, and the solid discharge outlet of the gas-solid separator is connected with the carbon-deposited contact agent return port of the cracking section.

Further, a water vapor stripping section is provided at the upper part within the cracking section; and/or a water vapor stripping section is provided between the cracking section and the gasification section. For example, the water vapor stripping section is provided at the upper part within the cracking section, then the carbon-deposited contact agent carried upwards by the light oil gas and the syngas is first subjected to water vapor stripping in the water vapor stripping section, so as to separate the carbon-deposited contact agent from the high-temperature oil gas; for another example, the water vapor stripping section is provided between the cracking section and the gasification section, the carbon-deposited contact agent descends to pass through the water vapor stripping section for water vapor stripping, and then enters into the gasification section.

The integrated method for heavy oil contact lightening and coke gasification provided by the present disclosure achieve mutual supply of materials and mutual complementation of heat in two reactions, i.e., the heavy oil cracking and the coke gasification, by the coupled reactor integrated with the cracking section and the gasification section. Especially, by adjustment of conditions such as flow of the syngas, type of gasification agent, it is possible to further achieve the matching of material stream and energy stream during heavy oil processing, ensure the stability throughout the heavy oil processing, and improve overall energy efficiency; by selection of an appropriate contact agent and adjustment of reaction conditions such as the agent-oil ratio in the cracking reaction, it is also possible to achieve the maximization of the yields of oil products in the process of cracking of the heavy oil and the high efficiency of the gasification process, and achieve the oil-gas co-production of heavy oil resources.

Therefore, compared with current process of heavy oil catalytic cracking and coke gasification, in which materials are transported and circulated among multiple reactors, the integrated method provided by the present disclosure can not only significantly reduce energy consumption during heavy oil processing, increase the yield of the light oil gas and reduce difficulties in material circulation operations, but also reduce the occupied area of heavy oil processing devices, and reduce equipment investment costs.

The integrated device for heavy oil contact lightening and coke gasification is used for implementing the above integrated method. The utilization of the integrated device achieves mutual supply of materials and mutual complementation of heat in the two reactions, the heavy oil cracking and the coke gasification, reduces energy consumption and difficulties in material circulation operations in the process of heavy oil processing, and increases the yield of the light oil gas. In addition, the integrated device also has a small occupied area and a low investment cost.

Figure 1:
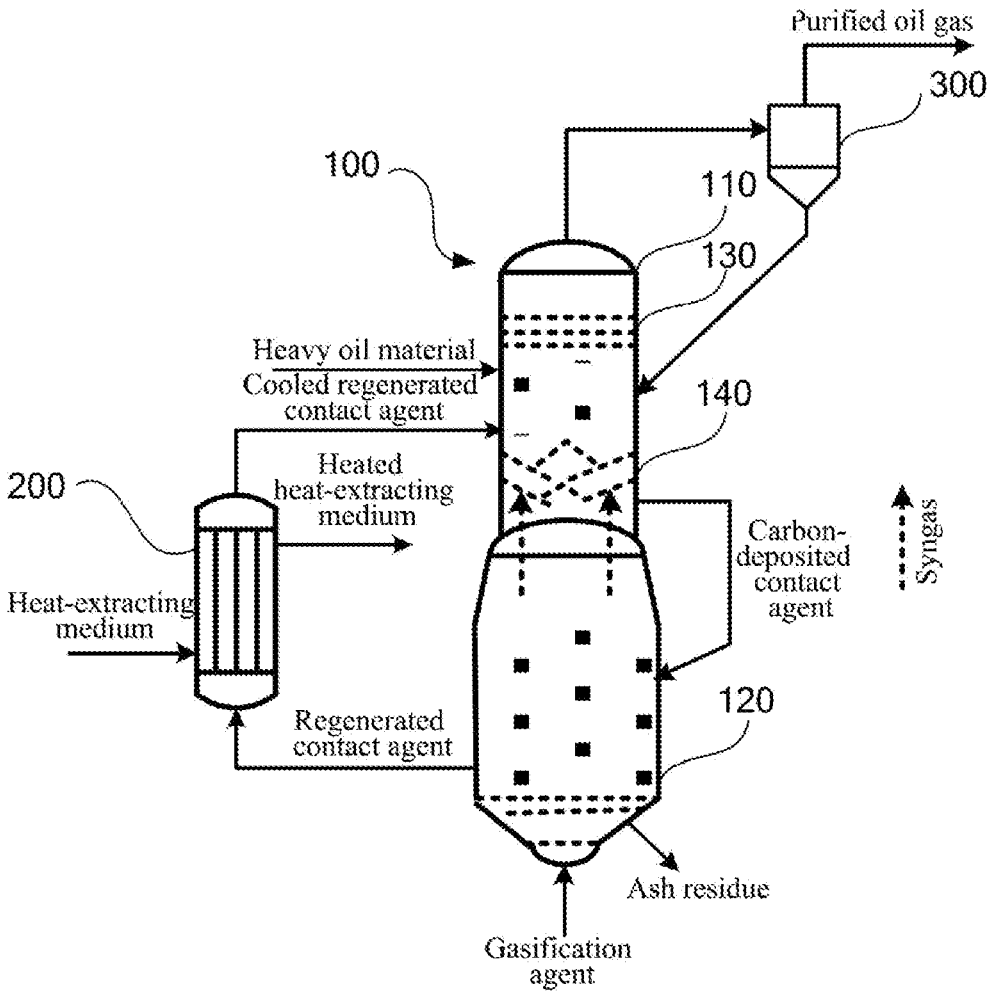
FIG. 1 is a first schematic diagram of an integrated device for heavy oil decarbonization and upgrading and coke gasification provided by a specific embodiment of the present disclosure.

The description of reference numbers in the drawings are as follows:

| | |
|---|---|
| 100- coupled reactor; | 110- cracking section; |
| 120- gasification section; | 130- cooling and washing section; |
| 140- water vapor stripping section; | 200- heat exchanger; |
| 300- gas-solid separator. | |

DESCRIPTION OF EMBODIMENTS

In order to make the objects, technical solutions and advantages of embodiments of the present disclosure more explicit, the technical solutions in the embodiments of the present disclosure will be described explicitly and completely in conjunction with accompanying drawings of the embodiments of the present disclosure. Obviously, the described embodiments are only part of the embodiments of the present disclosure, but not all embodiments. Based on the embodiments in the present disclosure, all other embodiments obtained by the skilled in the art without any creative work fall within the protection scope of the present disclosure.

Embodiment 1

The example of the present disclosure provides an integrated method for heavy oil contact lightening and coke gasification, the integrated method uses a coupled reactor as a reactor, the coupled reactor includes a cracking section at an upper part and a gasification section at a lower part, and the cracking section and the gasification section communicate with each other; the integrated method includes:

feeding a heavy oil material into the cracking section of the coupled reactor, so as to contact with a contact agent to implement a cracking reaction, to obtain a light oil gas and a carbon-deposited contact agent;

passing the carbon-deposited contact agent into the gasification section, so as to implement a gasification reaction with a gasification agent and regenerate the contact agent, to obtain a regenerated contact agent and a syngas; where the regenerated contact agent is returned into the cracking section for recycling after being cooled by heat exchange; and the syngas ascends into the cracking section;

discharging the light oil gas and the ascended and incorporated syngas from the cracking section, to perform a gas-solid separation, so that the carried carbon-deposited contact agent is separated and returned to the cracking section, and a purified oil gas is obtained at the same time.

The heavy oil material in the above integrated method, for example, can be one of viscous oil, super viscous oil, oil sand asphalt, atmospheric pressure heavy oil, vacuum residue, catalytic cracking slurry and solvent deoiled asphalt, etc., or a mixture of more thereof; and the heavy oil material can also be one of heavy tar and residue oil produced in the process of coal pyrolysis or liquefaction, heavy oil produced in the process of oil shale retorting, and derived heavy oil such as liquid product of low-temperature pyrolysis in biomass, or a mixture of more thereof.

In some embodiments of the present disclosure, Conradson' carbon residue value of the heavy oil material is greater than or equal to 10 wt %, and preferably, Conradson' carbon residue value of the heavy oil material is greater than or equal to 15 wt %.

The contact agent used in the above integrated method can be a commonly used contact agent for decarbonization and upgrading at present, especially it can be a contact agent with relatively low cracking activity, for example, a contact agent with a micro-activity index of 5-30, and in particular, the contact agent with the micro-activity index of 10-20 can be selected. In some embodiments of the present disclosure, the micro-activity index of the contact agent used is 10-20, for example, kaolin, clay, alumina, silica sol, and industrial balance agent or spent catalyst in a catalytic cracking process, etc.

Further, the contact agent is preferably in the shape of microsphere, its particle size distribution is in the range of 10-500 μm; in some embodiments of the present disclosure, the particle size distribution of the used contact agent is in the range of 20-200 μm.

In the above integrated method, in the process of the heavy oil cracking, it is preferable to maintain a content of a coke on a surface of the contact agent above 20 wt %, so as to ensure that the energy consumed in the heating process is mainly used for the gasification reaction of the coke, and improve overall energy efficiency of the entire process of heavy oil processing. In some embodiments of the present disclosure, within the cracking section, a reaction temperature is generally controlled to be 450-700° C., a reaction pressure is generally controlled to be 0.1-3.0 Mpa, a reaction time is generally controlled to be 1-20 s, a superficial gas velocity is generally controlled to be 1-20 m/s, a weight ratio of the contact agent to the heavy oil material is generally controlled to be 0.1-1.0:1. Preferably, the reaction temperature of the cracking section is 480-580° C., the reaction pressure is 0.1-1.0 Mpa, for example, normal pressure, the reaction time is 3-15 s, the superficial gas velocity is 1-20 m/s, and agent-oil ratio is 0.2-1.0:1, preferably 0.2-0.5:1.

In some embodiments of the present disclosure, within the gasification section, a reaction temperature is generally controlled to be 850-1200° C., a reaction pressure is generally controlled to be 0.1-6.0 Mpa, a superficial gas velocity is generally controlled to be 0.1-5 m/s, residence time of the carbon-deposited contact agent can be controlled to be 1-20 min. The gasification agent used can be, for example, water vapor, it can also be oxygen-containing gas or a mixed gas of water vapor and oxygen-containing gas. For example, the oxygen-containing gas can be air, oxygen, etc.

Further, before entering into the gasification section, the carbon-deposited contact agent from the cracking section is preferably subjected to water vapor stripping firstly, so as to remove the light oil gas remaining on the surface of the carbon-deposited contact agent, thereby facilitating gasification and regeneration. In some embodiments of the present disclosure, when performing the water vapor stripping, a mass ratio of the water vapor to the heavy oil material is controlled to be 0.03-0.3:1, a temperature of the water vapor is 200-400° C., and a superficial gas velocity of the water vapor is 0.5-5.0 m/s.

Embodiment 2

Figure 2:
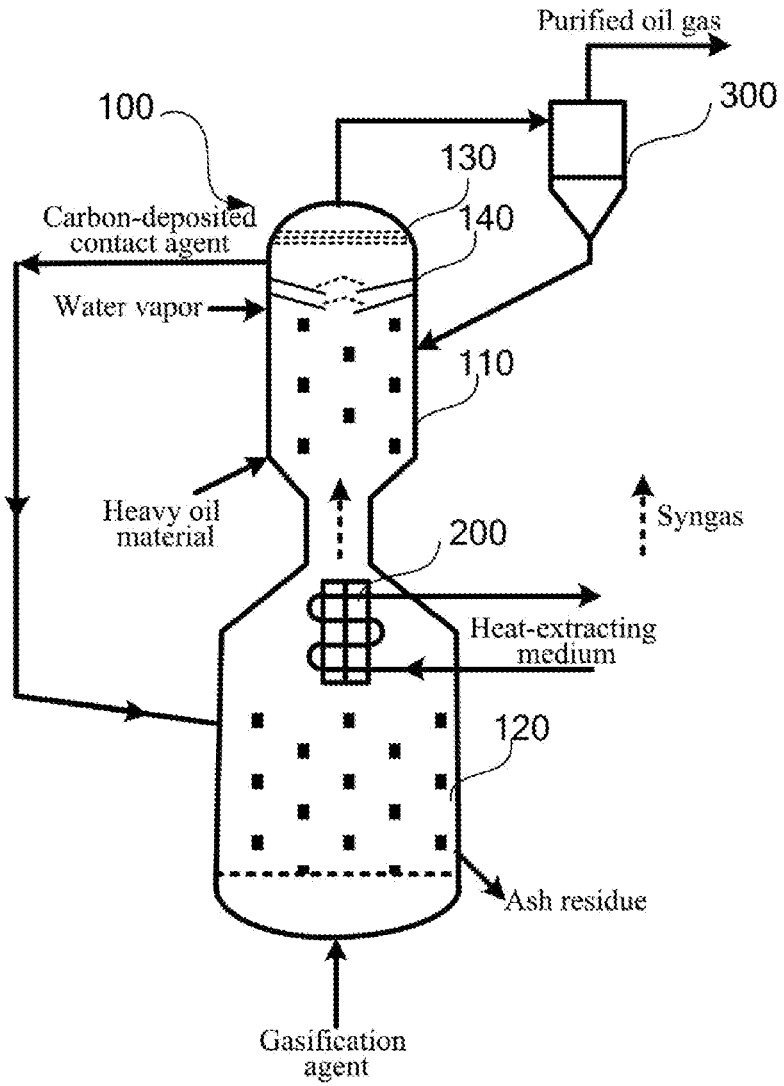
FIG. 2 is a second schematic diagram of an integrated device for heavy oil decarbonization and upgrading and coke gasification provided by a specific embodiment of the present disclosure.
Figure 3:
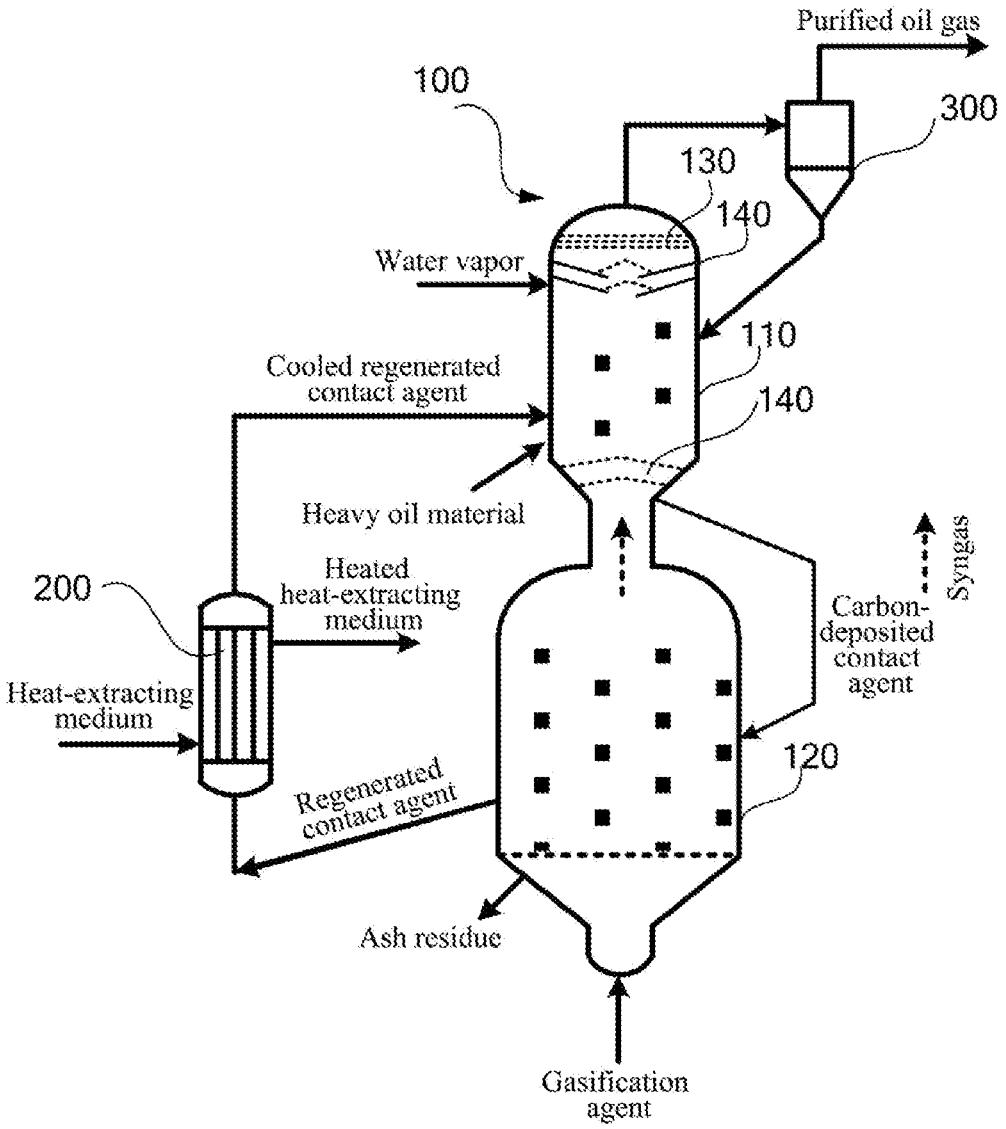
FIG. 3 is a third schematic diagram of an integrated device for heavy oil decarbonization and upgrading and coke gasification provided by a specific embodiment of the present disclosure.

The present embodiment provides an integrated device for heavy oil contact lightening and coke gasification, as shown in FIG. 1 to FIG. 3, the integrated device at least includes a coupled reactor 100, a heat exchanger 200 and a gas-solid separator 300, where:

the coupled reactor 100 includes a cracking section 110 at an upper part and a gasification section 120 at a lower part, and the cracking section 110 and the gasification section 120 communicate with each other; the cracking section 110 has a heavy oil material inlet, a carbon-deposited contact agent return port, a carbon-deposited contact agent outlet and an oil gas outlet; the gasification section 120 has a gasification agent inlet and a carbon-deposited contact agent inlet; the carbon-deposited contact agent outlet of the cracking section 110 is connected with the carbon-deposited contact agent inlet of the gasification section 120 through an external transportation pipeline (not shown);

the heat exchanger 200 is arranged inside the coupled reactor 100, or the heat exchanger 200 is arranged outside the coupled reactor 100 and is connected with the cracking section 110 and the gasification section 120;

the gas-solid separator 300 has an inlet, a solid discharge outlet and a gas discharge outlet, where the inlet of the gas-solid separator 300 is connected with the oil gas outlet of the cracking section 110, and the solid discharge outlet of the gas-solid separator 300 is connected with the carbon-deposited contact agent return port of the cracking section 110.

Specifically, the aforementioned coupled reactor 100 can specifically be obtained by appropriately modifying and assembling a cracking reactor and a gasification reactor commonly used in the art, where the cracking reactor can be, for example, a fluidized bed reactor, a bottom of which communicates with a top of the gasification reactor. The cracking reactor and the gasification reactor are preferably arranged coaxially, so as to facilitate the transportation and circulation of materials.

Further, the aforementioned integrated device can further includes an atomizer (not shown). The atomizer can be arranged outside the coupled reactor 100, and connected with the coupled reactor 100 through the heavy oil material inlet. In this case, after the heavy oil material is preheated, it can be firstly atomized in the atomizer, and then enters into the cracking section 110. The atomizer can also be arranged inside the coupled reactor 100, serving as an atomizing feed section of the coupled reactor 100, the atomizing feed section can be specifically provided in the cracking section 110 and correspond to the position of the heavy oil material inlet, so that after the preheated heavy oil material enters the cracking section 110 through the heavy oil material inlet, it is firstly subjected to atomization in the atomizing feed section, and then subjected to the cracking reaction.

Please further refer to FIG. 1 to FIG. 3, the aforementioned coupled reactor 100 can further includes a cooling and washing section 130, the cooling and washing section 130 is usually arranged at the upper part within the cracking section 110. Specifically, the cooling and washing section 130 can adopt a conventional structure of a coking fractionation tower or a washing section (or the desuperheating section) in the catalytic fractionation tower at present, and usually use a chevron baffle or a tongue-shaped column tray, which have 8 layers or 10 layers, in order to make an ascending high-temperature oil gas (i.e., the light oil gas and the syngas) and a descending low temperature liquid come into countercurrent contact in the cooling and washing section 130 for heat exchange, and to remove powders of the carbon-deposited contact agent carried in the high-temperature oil gas.

The aforementioned low temperature liquid can be, for example, the heavy oil material. Since the amount of the heavy oil material after heat exchange is not large, and the heavy oil material is fully dispersed in the process of exchanging heat with the high-temperature oil gas, the heavy oil material which is usually used as the low temperature liquid can directly perform the cracking reaction in the cracking section 110 after heated by heat exchange.

Specifically, the high-temperature light oil gas obtained by the cracking reaction and the syngas from the gasification section 120 ascend and pass through the cooling and washing section 130, so as to exchange heat with the low temperature liquid and be cooled to inhibit reactions such as excessive cracking and coke formation, and remove a small amount of the carbon-deposited contact agent particles carried in the high-temperature light oil gas and the syngas, then the high-temperature light oil gas and the syngas discharge from the oil gas outlet at the top of the cracking section 110 and are subjected to the gas-solid separation.

Please further refer to FIG. 1 to FIG. 3, the aforementioned coupled reactor 100 can further include a water vapor stripping section 140. Specifically, the water vapor stripping section 140 can include a multi-layer stripping structure, the multi-layer stripping structure can use one of chevron baffle, annular baffle, conical baffle, grille baffle, bulk packing and structured packing, or a combination of more thereof.

As shown in FIG. 1, the water vapor stripping section 140 can be arranged between the cracking section 110 and the gasification section 120, the carbon-deposited contact agent produced in the cracking section 110 passes through the water vapor stripping section 140 firstly, so as to remove light oil gas products remaining on the surface of the carbon-deposited contact agent, then it enters into the gasification section 120 for gasification and regeneration.

As shown in FIG. 2, the water vapor stripping section 140 can also be arranged at the upper part within the cracking section 110, for example, arranged below the cooling and washing section 130. The light oil gas and the syngas, which carry the carbon-deposited contact agent, first pass through the water vapor stripping section 140 for stripping and elutriating to remove the light oil gas remaining on the surface of the carbon-deposited contact agent solid particles, and then pass through the cooling and washing section 130, while the carbon-deposited contact agent is led out from the carbon-deposited contact agent outlet at the upper part of the cracking section 110, and transported outside the coupled reactor 100 to the gasification section 120.

As shown in FIG. 3, the coupled reactor 100 has two water vapor stripping sections 140, where one water vapor stripping section 140 is arranged at the upper part within the cracking section 110, the other water vapor stripping section 140 is arranged between the cracking section 110 and the gasification section 120. In this case, the light oil gas and the syngas carry a certain amount of the carbon-deposited contact agent particles, they first pass through the water vapor stripping section 140 at the upper part within the cracking section 110 for stripping and elutriating to remove the light oil gas product remaining on the surface of the carbon-deposited contact agent particles, so that the carbon-deposited contact agent is sufficiently separated from the high-temperature oil gas product and then is led out of the cracking section 110; and another part of the carbon-deposited contact agent particles descends to first pass through the water vapor stripping section 140 between the cracking section 110 and the gasification section 120 to remove the light oil gas product remaining on the surface of the carbon-deposited contact agent, and then is returned to the gasification section 120.

Furthermore, setting of the water vapor stripping section 140 between the cracking section 110 and the gasification section 120 can not only avoid coking and clogging problems of contact agent particles with a large size, but also achieve the separation of the cracking section 110 from the gasification section 120 to a certain extent, so that the cracking reaction and the gasification reaction can proceed relatively independently, increasing safety and operation stability of the entire coupled reactor 100.

As discussed above, the regeneration of the carbon-deposited contact agent occurs in the gasification section 120, to obtain the regenerated contact agent and the syngas. Since the inferior heavy oil has high heavy metal content and high ash content, it is easy to cause permanent deactivation of some contact agents in the process of heavy oil processing. Furthermore, metal and ash, which have a high content, in the heavy oil material, are also easy to accumulate on the contact agent, forming ash residue components that are difficult to be converted. Thus an ash residue outlet (not shown) is provided at the lower part of the gasification section 120. The discharged ash residue contains a high content of heavy metal, in which heavy metals such as Ni and V can be recycled through a subsequent processing device.

In the present embodiment, the aforementioned heat exchanger 200 is used to enable the regenerated contact agent from the gasification section 120 to be cooled to a suitable temperature by heat exchange, and the heat exchanger 200 can specifically be a heat extraction or heat exchange device commonly used in the field of petroleum processing. Please further refer to FIG. 1 and FIG. 3, the heat exchanger 200 can be arranged outside the coupled reactor 100, i.e. an external heat exchanger; or as shown in FIG. 2, the heat exchanger 200 can be arranged inside the coupled reactor 100, i.e. an internal heat exchanger, and is usually provided at the upper part within the gasification section 120.

Specifically, the aforementioned gas-solid separator 300 can be a gas-solid separation device commonly used in the field of petroleum processing. In some embodiments of the present disclosure, the gas-solid separator 300 used is a cyclone separator. In actual use, the light oil gas and the syngas, which carry the carbon-deposited contact agent, are led into a cyclone separator from an upper inlet, the centrifugal force generated when the gas-solid mixture is rotating at a high speed is utilized to separate the carbon-deposited contact agent from an airflow of the light oil gas and the syngas, and the separated carbon-deposited contact agent can be collected at the solid discharge outlet at the bottom of the cyclone separator, while purified oil gas is discharged from the gas discharge outlet at the top of the cyclone separator, and then is further processed and utilized.

In the present embodiment, part of materials is transported outside the coupled reactor 100, for example, the carbon-deposited contact agent from the cracking section 110 descends outside the coupled reactor 100 into the gasification section 120; for another example, after being cooled in the heat exchanger 200 by heat exchange, the regenerated contact agent from the gasification section 120 can be returned outside the coupled reactor 100 to the cracking section 110 for recycling; for still another example, the carbon-deposited contact agent from the gas-solid separator 300 is returned to the cracking section 110. The transportation of these materials can be accomplished by using material transportation devices or material transportation pipelines commonly used in the field of petroleum processing, for example, a material returning device (not shown) can be provided between the gas-solid separator 300 and the cracking section 110, so that the carbon-deposited contact agent separated in the gas-solid separator 300 is returned to the cracking section 110 by the material returning device; for another example, the heat exchanger 200 is connected with the gasification section 120 through an output pipeline (not shown), and connected with the cracking section 110 through a lifting pipeline (not shown), so that the regenerated contact agent that is gasified and regenerated in the gasification section 120 passes through the output pipeline to enter into the heat exchanger 200 for heat exchange and cooling, the regenerated contact agent after cooled further passes through an input pipeline to return to the cracking section 110 for recycling.

Further, the above integrated device can further include a gasification agent supply device (not shown) and a water vapor supply device (not shown). The gasification agent supply device is connected with the gasification section 120, and is used to supply a gasification agent, so that the gasification agent is led into the gasification section 120 from the gasification agent inlet at the bottom of the gasification section 120; and the water vapor supply device is used to supply water vapor at suitable temperature and flow rate into the coupled reactor 100, to form the water vapor stripping section 140.

In order to illustrate actual effects of the present disclosure, the embodiments of the present disclosure will be further described below in conjunction with specific application examples 1-3:

Application Example 1

Please refer to FIG. 1, after being sufficiently preheated and atomized, a heavy oil material entered into a cracking section 110 at an upper part of a coupled reactor 100 through a heavy oil material inlet, the atomized heavy oil droplets came into contact with a fluidized contact agent, and a decarbonization and upgrading reaction occurred, producing a light oil gas and a coke; the coke was attached to a surface of the contact agent, becoming a carbon-deposited contact agent.

The carbon-deposited contact agent descended in the cracking section 110, and passed through a water vapor stripping section 140 firstly, so as to remove the light oil gas product remaining on the surface of the carbon-deposited contact agent, and then was led out of the cracking section 110, and continued to descend into a gasification section 120 through an external transportation pipeline. Within the gasification section 120, the carbon-deposited contact agent performed a gasification reaction with a gasification agent entered from a gasification agent inlet at the bottom of the gasification section 120, so as to be regenerated, obtaining a regenerated contact agent and syngas.

The regenerated contact agent at high temperature entered into an external heat exchanger 200 through an output pipeline, after exchanging heat in the heat exchanger 200, the regenerated contact agent that is reduced to a suitable temperature was returned into the cracking section 110 through a lifting pipeline, so as to provide heat and catalytic activity required for the cracking reaction of the heavy oil.

The high temperature syngas ascended inside the coupled reactor 100 into the cracking section 110. The syngas was rich in active small molecules such as hydrogen and CO, can improve the yield and the quality of the light oil gas to a certain extent, meanwhile reduce the yield of the coke and improve the distribution of products derived from heavy oil cracking. Furthermore, it can also provide heat required for the cracking reaction of the heavy oil and ensure that the contact agent was fully fluidized.

A gas amount of the syngas ascended and the amount of the regenerated contact agent carried in the syngas can adjust and control gas velocity in bed by type and flow rate of the gasification agent, size of the reactor, etc., so as to ensure the matching of material stream and energy stream in the coupled reactor 100 and ensure a stable operation of the process system.

A gas distribution plate (not shown) can also be provided in the cracking section 110, so that the carbon-deposited contact agent in the cracking section 110 passed through the water vapor stripping section 140, and then prevented the carbon-deposited contact agent from entering into the gasification section 120 directly, and the carbon-deposited contact agent was discharged from a carbon-deposited contact agent outlet at the lower part of the cracking section 110; and the gas distribution plate can allow gas to pass through, so that the syngas from the gasification section 120 can pass through the gas distribution plate and incorporate into the light oil gas.

The light oil gas and the syngas that entered into the cracking section 110 from the gasification section 120 ascended, and they firstly passed through a cooling and washing section 130 to be cooled, with some fine powders of the carbon-deposited contact agent carried therein being removed, and then they were discharged from an oil gas outlet at the top of the cracking section 110 and entered into the gas-solid separator 300, for example, they entered into a cyclone separator for the gas-solid separation, and thus the carbon-deposited contact agent remained therein was separated and returned to the cracking section 110 through the external transportation pipeline, serving as a reaction bed material, providing part of heat required for the cracking reaction process and the cracking reaction site.

The purified oil gas obtained after purified by a cyclone separator can further pass through a system such as a gas-liquid fractionation tower and an oil and gas absorption stabilization tower, so as to obtain a gas product such as a syngas, a dry gas and a liquefied gas, and a light oil product, respectively. Of course, the obtained oil product can be further cut and separated to obtain a liquid product containing components with different distillation ranges, where the heavy oil (may include some solid particles of the contact agent) can be mixed with a heavy oil material for recycling and refining.

A vacuum residue available from a domestic refinery was processed according to the process of this Application Example 1, and properties of this raw oil were shown in Table 1.

As shown in Table 1, density, carbon residue value and asphaltene of the raw oil had a high content, and the raw oil had high amounts of sulfur, nitrogen and heavy metal components. The use of the traditional catalytic cracking process for processing had a severe tendency to form coke, and easily caused rapid inactivation of the catalyst due to carbon deposition or inactivation of the catalyst due to poisoning by heavy metal.

TABLE 1

| Item | Data |
|---|---|
| Density (20° C.), $kg \cdot m^{-3}$ | 993.8 |
| Viscosity (80° C.), $mm^2 \cdot s^{-1}$ | 5357.85 |
| Conradson' carbon residue value, wt % | 17.82 |
| Composition of Group, wt % | |
| Saturated Hydrocarbon | 21.13 |
| Aromatic Hydrocarbon | 35.33 |
| Colloid | 37.51 |
| Asphaltene | 6.03 |
| S, wt % | 1.10 |
| N, wt % | 1.03 |
| Ni, $\mu g \cdot g^{-1}$ | 79.4 |
| V, $\mu g \cdot g^{-1}$ | 88.1 |

The present process utilized a self-made decarbonization and upgrading contact agent with a certain micro-activity, and a cheap kaolin material was used for modification to obtain a high proportion of macroporous structure, with a large specific surface area and low acidity. The particle size distribution of the contact agent was mainly in the range of 20-100 μm, the packing density was 0.78-1.03 $g \cdot cm^{-3}$, the abrasion index was <1 wt %, and the micro-activity index was about 20.

The conditions of the cracking reaction were: the reaction temperature was 505° C., the reaction pressure was 0.1 Mpa, the catalyst to oil weight ratio was 0.5, the reaction time was 15 s, and the superficial gas velocity was 4.0 m/s.

The conditions of the gasification reaction were: the gasification agent was a mixed gas of water vapor and oxygen in a volume ratio of 1:1, the reaction temperature was 850° C., the reaction pressure was 0.1 Mpa, the superficial gas velocity was about 0.5 m/s, and the residence time of the carbon-deposited contact agent was about 10 min.

The conditions of water vapor stripping were: the mass ratio of the water vapor to the heavy oil material was 0.20, the temperature of the water vapor was 350° C., and the superficial gas velocity of the stripping water vapor was 2.5 m/s.

The light oil gas obtained by the cracking reaction and the syngas from the gasification section were subjected to a gas-solid separation and purified, to obtain final oil and gas products, the product distribution was shown in Table 2. Table 3 gave the composition of the syngas obtained by using the carbon-deposited contact agent as the gasification reaction material and performing the gasification reaction under the above conditions.

TABLE 2

| Product Distribution, wt % | Value |
|---|---|
| Dry Gas | 2.11 |
| Liquefied gas | 2.67 |
| Gasoline Fraction | 13.23 |
| Diesel Fraction | 20.17 |
| Wax Oil Fraction | 34.64 |
| >500° C. Heavy Oil Fraction | 11.59 |
| $C_3$ −500° C. | 70.71 |
| $C_5$ −500° C. | 68.04 |
| Total Liquid Yield | 79.63 |
| Coke | 15.59 |

As shown in Table 2, compared with the initial carbon residue value of the raw material, the ratio of coke yield to carbon residue value was about 0.8-0.9, which was far less than the ratio (1.4-1.6) of coke/carbon residue in delayed coking, indicating that an economic indicator of the integrated device in the present example is much higher than that of the heavy oil processing device in the prior art; the total liquid yield of the cracking of the heavy oil was close to 80%, most of which are light oil fractions less than 500° C., indicating that the use of the integrated process of the present example can realize lightening of the heavy oil and obtain a large number of oil products with a high added value, and have a very high processing efficiency; additionally, the heavy oil components greater than 500° C. can be further processed by refining.

TABLE 3

| Syngas Component | $H_2$ | CO | $CO_2$ | $CH_4$ and Other Components |
|---|---|---|---|---|
| Volume Content (vol %) | 41.5 | 37.7 | 19.5 | 1.3 |

As shown in Table 3, in the syngas obtained by the gasification of the coke, the sum of volume fractions of $H_2$ and CO was close to 80%. This high-quality syngas can be used in the subsequent reforming to produce hydrogen, supplementing hydrogen source in refineries.

Application Example 2

Please refer to FIG. 2, after being sufficiently preheated, the heavy oil material was atomized through the heavy oil material inlet and entered into the cracking section 110 at the upper part of the coupled reactor 100, the atomized heavy oil droplets came into contact with the fluidized contact agent, and a decarbonization and upgrading reaction occurs, to produce a light oil gas and a coke attached to the surface of the contact agent.

Different from Application Example 1, in Application Example 2, the gas velocity in the coupled reactor 100 was great, and the heavy oil material inlet was located at the lower part of the cracking section 110, and the carbon-deposited contact agent outlet was located at the upper part of the cracking section 110.

The light oil gas at high temperature and the syngas ascended and entered from the gasification section 120 carried a large amount of the carbon-deposited contact agent particles and ascended, they first passed through the water vapor stripping section 140 for stripping and elutriating to remove the light oil gas product remaining on the surface of the carbon-deposited contact agent solid particles, so that the carbon-deposited contact agent was sufficiently separated from the high-temperature oil gas product, and the separated carbon-deposited contact agent was discharged from the carbon-deposited contact agent outlet at the upper part of the cracking section 110, extracted by the external transportation pipeline and descended into the gasification section 120. The high-temperature oil gas continued to ascend, passed through the cooling and washing section 130 to be cooled to enable some carbon-deposited contact agent particles remaining therein to be removed, and then was discharged from the oil gas outlet at the top of the cracking section 110 and entered into the cyclone separator for gas-solid separation, and the carbon-deposited contact agent remained in the high-temperature oil gas was sufficiently separated and returned to the cracking section 110 through the external transportation pipeline, serving as the reaction bed material, providing part of heat required for the cracking reaction process and the cracking reaction site.

Specifically, the cracking section 110 can be regarded as a fast fluidized bed (that is, the gas velocity in the bed was higher, the residence time of the oil gas can be shorter), the gasification section 120 was regarded as a slow fluidized bed (that is, the superficial gas velocity in the fluidized bed was slower). In this case, the particle concentration in the bed (dense-phase bed) was great, the residence time was long, facilitating sufficient gasification reaction. Therefore, the entire coupled reactor 100 can be regarded as an ascending fluidized bed. The heavy oil in the cracking section 110 had a fast the cracking reaction rate (reaction for a long time was relatively unfavorable for generation of the oil gas); and the coke in the gasification section 120 had a slow gasification reaction rate, which requires a long reaction time to increase the conversion rate of the gasification of the coke on the surface to obtain the syngas with high quality. Therefore, this process implementation method was very suitable for an actual industrialized process.

The purified oil gas obtained by separating the carbon-deposited contact agent through the cyclone separator can further pass through a system such as a gas-liquid fractionation tower and an oil and gas absorption stabilization tower, so as to obtain a gas product such as a syngas, a dry gas and a liquefied gas, and a light oil product, respectively. Of course, the obtained oil product can be further cut and divided to obtain liquid products as components with different distillation ranges, where the heavy oil (may include some solid particles of the contact agent) can be mixed with the heavy oil material for recycling and refining.

Within the gasification section 120, the carbon-deposited contact agent transported through the external transportation pipeline performs a gasification reaction with the gasification agent (water vapor, oxygen/air, etc.) provided by the gasification agent supply device at a high temperature, to obtain a syngas with high quality, and the contact agent was regenerated at the same time.

The inferior heavy oil has high heavy metal content and high ash content, this part of heavy metal and ash were easy to accumulate on the contact agent or in the coupled reactor 100, forming ash residue components which were difficult to be converted. This part of ash residue components can be discharged through the ash residue outlet provided at the bottom of the gasification section 120. The discharged ash residue components contained a high content of heavy metals, in which heavy metals such as Ni and V can be recycled by a subsequent processing.

The regenerated contact agent with surface coke removed was carried by the syngas and a large number of gasification agent, and ascended to pass through the heat exchanger 200 provided in the gasification section 120, to exchange heat with a heat-extracting medium such as low temperature water vapor. After the heat exchange was completed, the heated heat-extracting medium was discharged from the heat exchanger 200, while the regenerated contact agent reduced to a suitable temperature continued to ascend into the cracking section 110, so as to provide heat and catalytic activity required for the cracking reaction of the heavy oil.

The ascended high temperature syngas entered into the cracking section 110, to provide heat required for the cracking reaction of the heavy oil, and ensure that the contact agent was fully fluidized. Since the syngas was rich in active small molecules such as hydrogen and CO, it can improve the yield and the quality of the light oil gas to a certain extent, meanwhile reduce the yield of the coke and improve the distribution of products from heavy oil cracking.

The gas amount of the ascended syngas and the circulation amount of the regenerated contact agent can be adjusted and controlled by type and flow rate of the gasification agent, size of the coupled reactor 100, etc., so as to ensure the matching of material stream and energy stream in the coupled reactor 100, and ensure the stable operation of the process system, and improve overall energy efficiency of the system.

Application Example 3

Please refer to FIG. 3, after being sufficiently preheated, the heavy oil material was atomized through the heavy oil material inlet and entered into the cracking section 110 at the upper part of the coupled reactor 100, the atomized heavy oil droplets came into contact with the fluidized contact agent, and then a decarbonization and upgrading reaction of occurs, producing a light oil gas and a coke that was attached to the surface of the contact agent.

Within the cracking section 110, under the condition of relatively small weight ratio (e.g., agent-oil ratio was 0.1-0.5) of the contact agent and the heavy oil material, a relatively high content of coke willed be formed on the surface of the contact agent. Except a small amount of the coke-forming contact agent (coke-deposited contact agent) that was carried by the light oil gas and the syngas to ascend and finally left the cracking section 110, most of the remaining carbon-deposited contact agent descended into the gasification section 120. Specifically, a ratio of the ascending carbon-deposited contact agent and the descending carbon-deposited contact agent in the cracking section 110 was adjusted by controlling the gas velocity in the coupled reactor 100, so as to ensure a stable operation of the entire integrated device and the matching of material stream and energy stream.

Specifically, most of the carbon-deposited contact agent, especially the carbon-deposited contact agent with larger particles, descended in the cracking section 110, and they passed through the water vapor stripping section 140 firstly, so as to remove the light oil gas products remaining on the surface of the carbon-deposited contact agent, and then were transported to the gasification section 120 through an external transportation pipeline. Within the gasification section 120, the carbon-deposited contact agent performed a gasification reaction with the gasification agent (water vapor, oxygen/air, etc.) provided by the gasification agent supply device at high temperature, to obtain a syngas with high quality, and the contact agent was regenerated at the same time.

The inferior heavy oil has a high heavy metal content and a high ash content, this part of heavy metals and ashes are easy to accumulate on the contact agent or in the coupled reactor 100, forming ash residue components that are difficult to be converted. This part of ash residue components can be discharged through the ash residue outlet provided at the bottom of the gasification section 120. The discharged ash residue components contained a high content of heavy metals, in which heavy metals such as Ni and V can be recycled by a subsequent processing.

The regenerated contact agent, from which carbon deposited on a surface was removed within the gasification section 120, entered into the heat exchanger 200 provided outside the coupled reactor 100 through an output pipeline, to exchange heat with a heat-extracting medium such as low temperature water vapor. After the heat exchange was completed, the heated heat-extracting medium was discharged from the heat exchanger 200, the regenerated contact agent reduced to a suitable temperature ascended into the cracking section 110 through a lifting pipeline, so as to provide heat and catalytic activity required for the cracking reaction of the heavy oil.

The high temperature syngas carried a very small amount of the regenerated contact agent, directly ascended within the coupled reactor 100 into the cracking section 110, so as to provide heat required for the cracking reaction of the heavy oil, and ensure that the contact agent was fully fluidized. Since the syngas was rich in active small molecules such as hydrogen and CO, it can improve the yield and the quality of the light oil gas to a certain extent, meanwhile reduce the yield of coke and improve the distribution of products from heavy oil cracking.

The light oil gas produced in the cracking section 110 and the syngas from the cracking section 110 carried a certain amount of the carbon-deposited contact agent (especially the carbon-deposited contact agent with smaller particles) to ascend, they first passed through the water vapor stripping section 140 for stripping and elutriating to remove the light oil gas products remaining on the surface of the carbon-deposited contact agent particles, so that the carbon-deposited contact agent was sufficiently separated from the high-temperature oil gas product, and then they are cooled in the cooling and washing section 130, with some fine powders of the carbon-deposited contact agent carried therein being removed, and finally, they were discharged from the oil gas outlet at the top of the cracking section 110 and entered into the cyclone separator for gas-solid separation; the separated carbon-deposited contact agent was returned into the cracking section 110 through an external transportation pipeline, and served as a reaction bed material, providing part of heat required for the cracking reaction process and the cracking reaction site; the purified oil gas can pass through a system such as a gas-liquid fractionation tower and an oil and gas absorption stabilization tower, to obtain a gas product such as a syngas, a dry gas and a liquefied gas, and a light oil product, respectively. Of course, the obtained oil product can be further cut and separated to obtain liquid products as components with different distillation ranges, where the heavy oil can be mixed with a heavy oil material for recycling and refining.

In the present application example, by coupling the cracking section 110 and the gasification section 120 in the form of up-and-down communication, a mutual supply of materials and a mutual complementation of heat between the cracking reaction of the inferior heavy oil and the gasification reaction of the coke was achieved, effectively solving the problems of high energy consumption, big difficulty in material transportation and large equipment occupied area, etc. in the co-production process of heavy oil lightening and high-quality syngas. Furthermore, the gas amount of the ascended syngas and the amount of the regenerated contact agent carried therein can be adjusted and controlled by type and flow rate of the gasification agent, size of the coupled reactor 100, etc., which can ensure the matching of material stream and energy stream in the coupled reactor 100, and ensure a stable operation of the process system.

At the same time, the heat exchanger 200 arranged outside the coupled reactor 100 was utilized to partially extract heat from the ascending high-temperature regenerated contact agent, further improving the energy utilization rate of the entire integrated device.

Furthermore, setting of the water vapor stripping section 140 between the cracking section 110 and the gasification section 120 achieves the separation of the cracking reaction and the gasification reaction to a certain extent, and avoids, for example, coking and clogging problems of contact agent particles with a large size, so that the two reaction can proceed relatively independently, increasing safety and operational stability of the entire integrated device.

Finally, it should be noted that the above examples are only used to illustrate the technical solutions of the present disclosure, without limitation to the present disclosure. Although the present disclosure has been described in detail with reference to the foregoing examples, those skilled in the art should understand: modifications to the technical solutions described in the foregoing examples, or equivalent substitutions of some or all of the technical features therein can still be made. These modifications or substitutions do not make the essence of the corresponding technical solutions deviate from the scope of the technical solutions of the examples of the present disclosure.

What is claimed is:

1. An integrated method for heavy oil contact lightening and coke gasification, wherein the integrated method uses a coupled reactor as a reactor, the coupled reactor comprises a cracking section at an upper part and a gasification section at a lower part, and the cracking section and the gasification section communicate with each other; the integrated method comprises:

feeding a heavy oil material into the cracking section of the coupled reactor, so as to contact with a contact agent to implement a cracking reaction, to obtain a light oil gas and a carbon-deposited contact agent;

passing the carbon-deposited contact agent into the gasification section, so as to implement a gasification reaction with a gasification agent and regenerate the contact agent, to obtain a regenerated contact agent and a syngas; wherein the regenerated contact agent after being cooled by heat exchange is returned into the cracking section for recycling, and the syngas ascends into the cracking section; and discharging the light oil gas and the ascended and incorporated syngas from the cracking section, to perform a gas-solid separation, so that the carbon-deposited contact agent carried is separated and returned to the cracking section, and a purified oil gas is obtained at the same time.

2. The integrated method according to claim 1, wherein Conradson' carbon residue value of the heavy oil material is >10 wt %.

3. The integrated method according to claim 1, wherein a micro-activity index of the contact agent is 5-30; and/or a particle size distribution of the contact agent is 10-500 μm.

4. The integrated method according to claim 1, wherein a mass content of a coke in the carbon-deposited contact agent is above 20%.

5. The integrated method according to claim 1, wherein within the cracking section, a reaction temperature is 450-700° C., a reaction pressure is 0.1-3.0 Mpa, a reaction time is 1-20 s, a superficial gas velocity is 1-20 m/s, and a weight ratio of the contact agent to the heavy oil material is 0.1-1.0:1.

6. The integrated method according to claim 1, wherein within the gasification section, a reaction temperature is 850-1200° C., a reaction pressure is 0.1-6.0 Mpa, a superficial gas velocity is 0.1-5 m/s, a residence time of the carbon-deposited contact agent is 1-20 min; and the gasification agent is water vapor and/or oxygen-containing gas.

7. The integrated method according to claim 1, further comprising performing a water vapor stripping treatment before the carbon-deposited contact agent is transported outside the coupled reactor into the gasification section.

8. The integrated method according to claim 7, wherein when performing the water vapor stripping treatment, a mass ratio of water vapor to the heavy oil material is controlled to be 0.03-0.3:1, a temperature of the water vapor is 200-400° C., and a superficial gas velocity of the water vapor is 0.5-5.0 m/s.

* * * * *